United States Patent [19]

Cappucci

[11] 4,237,434

[45] Dec. 2, 1980

[54] RIDGE WAVEGUIDE MODE SUPPRESSOR

[75] Inventor: Joseph D. Cappucci, Wayne, N.J.

[73] Assignee: Merrimac Industries Incorporated, West Caldwell, N.J.

[21] Appl. No.: 26,083

[22] Filed: Apr. 2, 1979

[51] Int. Cl.[3] ..... H01P 1/162; H01P 1/203; H01P 3/123

[52] U.S. Cl. ..... 333/202; 333/204; 333/251; 361/399

[58] Field of Search ..... 333/238, 246, 251, 202–204, 333/12, 208–210; 361/395, 399, 412, 415

[56] References Cited

U.S. PATENT DOCUMENTS

| | | | |
|---|---|---|---|
| 3,258,724 | 6/1966 | Walsh et al. | 333/238 |
| 3,638,148 | 1/1972 | Hallford et al. | 333/246 |
| 3,870,974 | 3/1975 | Ohlstein et al. | 333/12 |

OTHER PUBLICATIONS

Southworth–"Principles and Applications of Waveguide Transmission", D. Van Nostrand, New York, 1961; pp. 131–136.

*Primary Examiner*—Marvin L. Nussbaum

*Attorney, Agent, or Firm*—Lerner, David, Littenberg & Samuel

[57] ABSTRACT

A ground plane element in a channel has a width slightly less than the channel width, thus forming a ridge mode waveguide. Means such as conducting strips are used to suppress the ridge mode. The strips are preferably corrugated for good contact and to firmly secure them. The suppressing means can prevent bypassing a microwave low pass filter.

7 Claims, 4 Drawing Figures

RIDGE WAVEGUIDE MODE SUPPRESSOR

BACKGROUND OF THE INVENTION

The present invention relates to microwave circuits and more particularly to means for suppressing ridge waveguide modes that can propagate in such circuits.

Microwave circuits, such as a strip line low pass filter, are typically placed on top of a ground plane block and then both are mounted within a channel. Ideally, the width of the block should be the same as that of the channel. However, due to the requirements of being able to make design changes, or not being able to machine the block to the exact width at a reasonable cost, it is not always feasible to make both widths exactly the same. Therefore, spaces occur between the block and the box, which spaces form, with other surfaces present, a "ridge waveguide." This type of waveguide has a much lower cutoff frequency than that of an ordinary one of similar overall external dimensions. If the microwave circuit is a low pass filter, the result can be that signals having a frequency that are higher than that of the filters cutoff frequency and lower than the cutoff frequency of the waveguide formed by the channel in the box are propagated along the ridge guide, thus bypassing the filter. This is an effective raising of the filter's cutoff frequency which is not desired.

SUMMARY OF THE INVENTION

It is, therefore, an object of the present invention to suppress ridge waveguide modes in microwave circuitry.

It is another object to prevent bypassing of a low pass filter.

It is yet another object to allow less accurate machining in microwave circuits, which is less expensive.

It is a further object to allow design changes in such circuits.

In brief, these and other objects are achieved by having conducting channel defining members forming a cavity of a selected width. A ground plane element is disposed in said cavity, but has a width less than said selected width, therefore forming a ridge waveguide. A microwave circuit is on top of the element. A ridge waveguide mode suppressing means is disposed in said space. If the circuit comprises a low pass filter, then the mode suppressing means prevents the filter from being bypassed. The mode suppressing means can comprise corrugated conducting strips for easy insertion and good electrical contact.

BRIEF DESCRIPTION OF THE DRAWINGS

These and other objects, features and advantages will become apparent from the following description when taken in conjunction with the drawings in which.

DETAILED DESCRIPTION OF THE INVENTION

Figure 1:
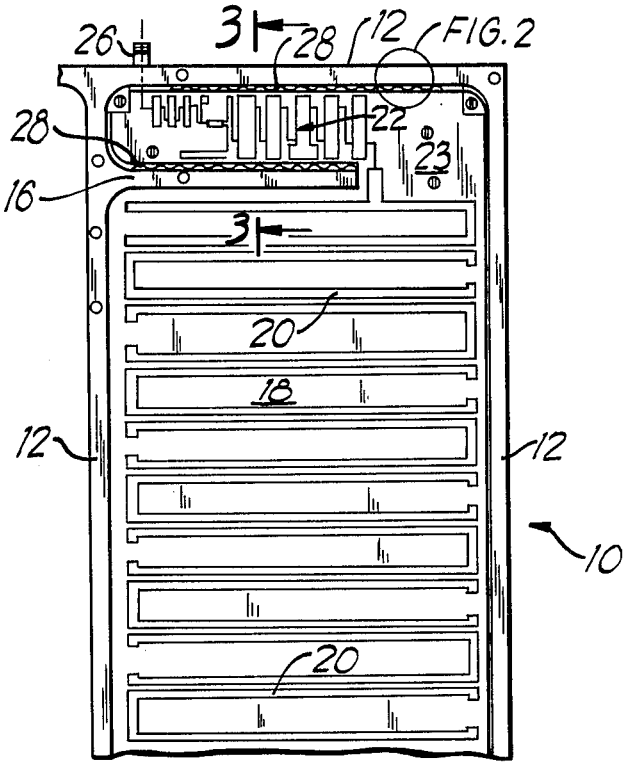
FIG. 1 is a top view of a circuit incorporating the invention.
Figure 3:
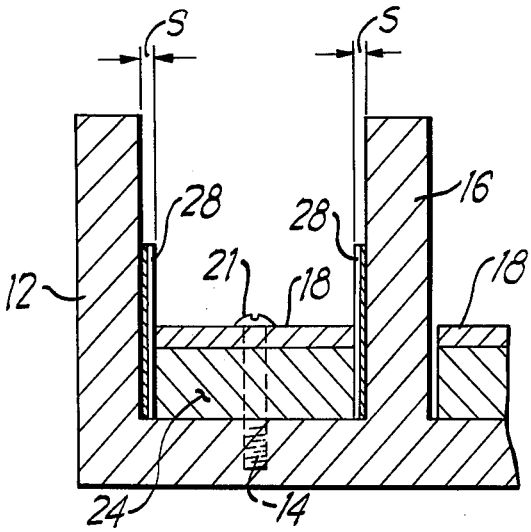
FIG. 3 is a side view of the invention taken along line 3 of FIG. 1.

FIG. 1 shows a machined aluminum box 10 having side walls 12, an integral bottom 14, and an integral interior wall 16. As best seen in FIG. 3, the interior wall

16, one of the side walls 12 and a portion of bottom 14 form a channel that has a selected width. A printed circuit board 18 is mounted within the box 10 and has a first section that has printed thereon a band pass filter 20 of the hairpin stripline type. In the channel, the board 18 has a low pass strip line filter 22 printed on it. The short length of wall 16 provides a port 23 for coupling filters 20 and 22 together. Underneath the board 18 and within the channel is an aluminum block 24 having a top surface that forms a ground plane for filter 22. A screw 21 secures the board 18 and block 24 to bottom 14. The width of block 24 is slightly smaller than the width of the channel due to design changes or the expense of machining for a perfect fit. The result is spaces of width "s" on either side of the block 24 between it and the walls 12 and 16, thereby resulting in a ridge waveguide. A coaxial connector 26 is mounted on wall 12 and coupled to filter 22 to provide an output signal.

In operation, microwave signals are applied to filter 20 by means (not shown). The signals are bandpass filtered by filter 20 and go through port 23 to filter 22. However, the ridge waveguide of similar overall exterior dimensions, which results in microwave signals that would have been filtered out by filter 22 bypassing it and being supplied by connector 26.

Figure 2:
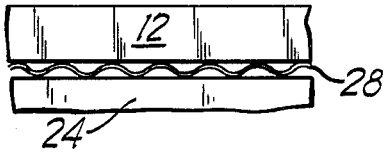
FIG. 2 is a top close-up view of the invention.
Figure 4:
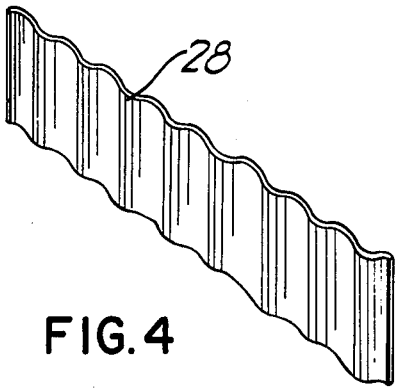
FIG. 4 is a view of ridge waveguide mode suppressing strips in accordance with the invention.

To overcome this problem, a pair of gold plated, corrugated, berylium copper strips 28, one being shown in FIG. 4, are placed between block 24 and wall 12, as is shown in FIG. 2, and between block 24 and wall 16 respectively. The springy character of the material keeps the strips 28 in place and insures a good electrical contact to the block 24 and the walls 12 and 16. The strips spoil the ridge guide modes and allow the system to propagate only normal waveguide modes bounded by the board 18. The result is that the filter 22 is now fully effective, its cutoff frequency determining the highest frequency of signals that are present at connector 26.

It will be appreciated that many other embodiments are possible without departing from the spirit of the invention.

What is claimed is:

1. A transmission device comprising a conducting channel member having a cavity of a selected width, a conducting ground plane element disposed in said cavity and having a width less than said selected width, whereby a space is formed between said channel member and said ground plane element, whereby said space allows ridge waveguide modes to propagate a printed circuit board disposed on top of said ground plane element and having a width slightly less than said selected width said circuit board comprising a low pass filter having a selected cut off frequency and means disposed in said space for suppressing said ridge waveguide modes thereby preventing bypassing of said filter.

2. A transmission device as claimed in claim 1, wherein said suppressing means comprises a conducting strip.

3. A transmission device as claimed in claim 2, wherein said strip is corrugated.

4. A transmission device as claimed in claim 2, wherein said strip comprises gold plated, berylium copper.

5. A transmission device as claimed in claim 1, wherein said channel member comprises machined aluminum.

6. A transmission device as claimed in claim 1, wherein said channel member and said ground plane element are rectangular, whereby said space is of constant width.

7. A transmission device as claimed in claim 1, whereby said ground plane element comprises an aluminum block and further comprising a screw extending through said ground plane element into said channel member.

* * * * *